US006513196B2

(12) United States Patent
Snowden et al.

(10) Patent No.: US 6,513,196 B2
(45) Date of Patent: Feb. 4, 2003

(54) TOP COVER HINGE AND METHOD FOR USING SAME

(75) Inventors: Mark S. Snowden, Newton, IA (US); Paul A. Reynolds, Herrin, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/887,891

(22) Filed: Jun. 22, 2001

(65) Prior Publication Data

US 2002/0194704 A1 Dec. 26, 2002

(51) Int. Cl.[7] ..... E05D 1/06

(52) U.S. Cl. ..... 16/268; 16/225; 16/387; 16/DIG. 12; 16/384; 220/4.22; 220/845

(58) Field of Search ..... 16/268, DIG. 12, 16/225, 384, 387–390; 220/845, 847, 848, 4.22, 837, 840, 842; 312/315.6, 315.9

(56) References Cited

U.S. PATENT DOCUMENTS

| | | | | | |
|---|---|---|---|---|---|
| 444,299 | A | | 1/1891 | Mills | |
| 676,509 | A | | 6/1901 | McNown | |
| 1,069,364 | A | | 8/1913 | Winter | |
| 1,605,458 | A | * | 11/1926 | Neeb | 16/268 |
| 2,660,273 | A | | 11/1953 | Rogers | |
| 2,722,034 | A | * | 11/1955 | May | 16/268 |
| 3,592,354 | A | * | 7/1971 | Nielsen | 16/225 |
| 3,878,585 | A | | 4/1975 | Morris | |
| 4,079,498 | A | | 3/1978 | Blevins | |
| 4,115,901 | A | | 9/1978 | Schmidt | |
| 4,123,822 | A | | 11/1978 | Bentley | |
| 4,437,529 | A | | 3/1984 | Fralish | |
| 4,574,425 | A | * | 3/1986 | Sugiura | 16/225 |
| 4,696,412 | A | * | 9/1987 | McGowan et al. | 16/257 |
| 4,787,121 | A | | 11/1988 | Racenis et al. | |
| 4,852,213 | A | | 8/1989 | Shewchuk | |
| 4,914,781 | A | | 4/1990 | Sokn et al. | |
| 5,148,850 | A | * | 9/1992 | Urbanick | 16/225 |
| 5,441,167 | A | * | 8/1995 | Shigeru | 16/374 |
| 5,513,909 | A | | 5/1996 | Teich | |
| 5,641,086 | A | * | 6/1997 | Sonntag et al. | 16/232 |
| 6,099,097 | A | | 8/2000 | Hocker et al. | |

FOREIGN PATENT DOCUMENTS

| | | | |
|---|---|---|---|
| CA | 951061 | | 7/1974 |
| DE | 3739033 | A1 * | 5/1989 |

* cited by examiner

*Primary Examiner*—Chuck Y. Mah
(74) *Attorney, Agent, or Firm*—McKee, Voorhees & Sease, P.L.C.

(57) ABSTRACT

A hinge is provided for hinging the top cover of an appliance to the remaining cabinet. The hinge body includes an upper end, a lower end, first and second opposite lateral edges, a front face, and a rear face. The hinge body includes one or more appendages protruding outwardly from the front face of the hinge body. The hinge body also includes a hook formed therein and protruding upwardly from the upper edge of the hinge body. The hook is adapted to fit within a hook-receiving opening in the top cover and the appendages of the hinge body are adapted to fit within openings in the cabinet.

24 Claims, 6 Drawing Sheets

TOP COVER HINGE AND METHOD FOR USING SAME

BACKGROUND OF THE INVENTION

This invention relates to a top cover hinge and method for using same.

Many appliances include a cabinet having a top cover forming the upper surface thereof. During normal operation the top cover is secured in place and is not removable. However, for purposes of repair, it is desirable to be able to pivot the top cover upwardly so as to gain access to the interior of the appliance for repair.

A preferred method for permitting this motion is to hinge the back edge of the top cover so that it can be pivoted upwardly about a horizontal axis. Various types of hinges have been provided for this purpose.

Therefore, a primary object of the present invention is the provision of an improved top cover hinge and method for using same.

A further object of the present invention is the provision of a hinge that is compatible with prepainted sheet metal parts.

Another object of the present invention is the provision of a hinge that is made of plastic so as to minimize damaging of objects with which it comes in contact.

A further object of the present invention is the provision of an improved hinge that minimizes damage to the cabinet and the top cover.

A further object of the present invention is the provision of an improved hinge that minimizes damage to sheet rock walls in homes as the result of the hinge protruding outwardly from the cabinet.

A further object of the present invention is the provision of an improved hinge that requires less tooling and equipment maintenance in manufacture as compared to present methods for making hinges of this type.

A further object of the present invention is the provision of an improved hinge that eliminates the need for top cover sheet metal gussets and the need for a sheet metal hinge.

A further object of the present invention is the provision of an improved hinge that does not require welding to the cabinet.

A further object of the present invention is the provision of an improved hinge that is made of one piece and which is economic to manufacture, durable in use, and simple in assembly.

A further object of the present invention is the provision of an improved hinge that can be replaced easily in the field.

A further object of the present invention is the provision of an improved hinge which functions to hold the top cover down and which minimizes the movement of the top cover in a forward-rearward direction and in a left-right direction.

A further object of the present invention is the provision of an improved hinge for a top cover, which includes stops for holding the top cover in an upright position while servicing the machine.

A further object of the present invention is the provision of an improved hinge, which maintains the correct gap between the upper edge of the cabinet and the top cover.

BRIEF SUMMARY OF THE INVENTION

The foregoing objects may be achieved by a hinge that includes a hinge body comprised of an upper end, a lower end, first and second opposite lateral edges, a front face, and a rear face. The hinge body has one or more appendages protruding outwardly from the front face thereof. The hinge body also includes a hook formed therein and protruding upwardly from the upper edge of the hinge body, the hook having a curved shape extending forwardly beyond the front face of the hinge body and terminating in a hook end.

According to one feature of the invention, the hinge body is comprised of one-piece construction.

According to another feature of the invention, at least one of the appendages of the hinge body extends from the front face of the hinge body below the hook.

According to a further feature of the present invention a second of the appendages extends from the front face adjacent and above the lower end of the hinge body.

According to another feature of the present invention a third and a fourth appendage are located adjacent the first and second opposite lateral edges of the hinge body.

According to a modified form of the present invention the first and second appendages each have a lateral width extending between the first and second lateral edges of the hinge body, the lateral widths of the first and second appendages being greater than one-half of the distance between the first and second opposite edges of the hinge body.

According to another feature of the present invention, the hinge body described above is used in combination with a top cover and a remaining cabinet. The hinge body is attached to the cabinet wall and the hook portion of the hinge body extends into an opening in the top cover to permit pivoting of the top cover with respect to the hook portion about a hinge axis.

The method of the present invention comprises attaching the hinge body to the cabinet wall; inserting the hook portion of the hinge body into the hook receiving hole of the top cover; and pivoting the top cover about a fulcrum created by the hook portion from a horizontal position to a vertical position.

Further features of the method of the present invention include inserting a plurality of appendages on the hinge body into a plurality of appendage receiving holes in the cabinet wall so as to stabilize the hook member against movement with respect to the cabinet wall.

A further feature of the method includes using a securing member extending through both the hinge body and the cabinet wall to attach the hinge body to the cabinet wall.

DETAILED DESCRIPTION OF THE INVENTION

Figure 1:
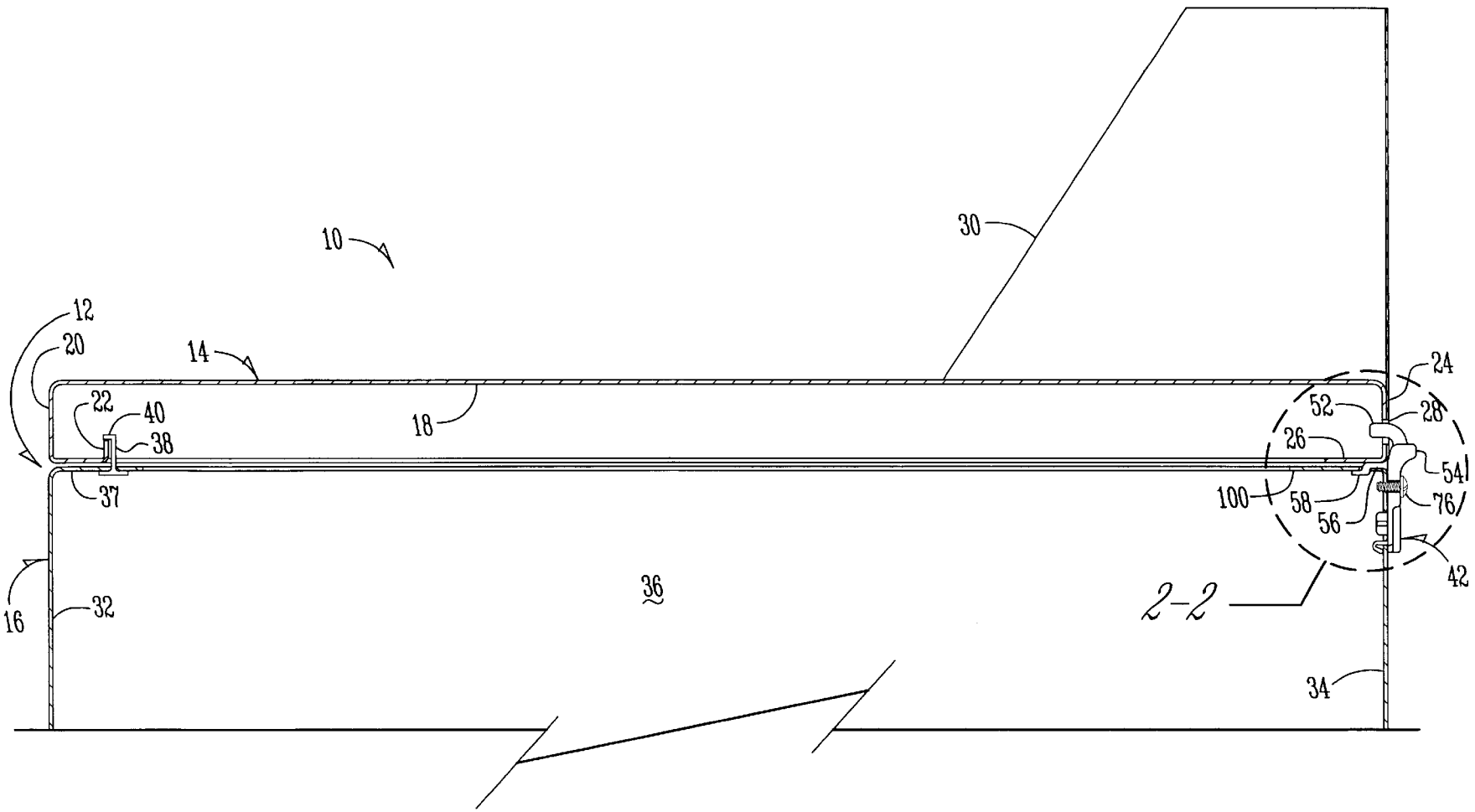
FIG. 1 is a partial sectional view of an appliance cabinet utilizing the hinge of the present invention.
Figure 2:
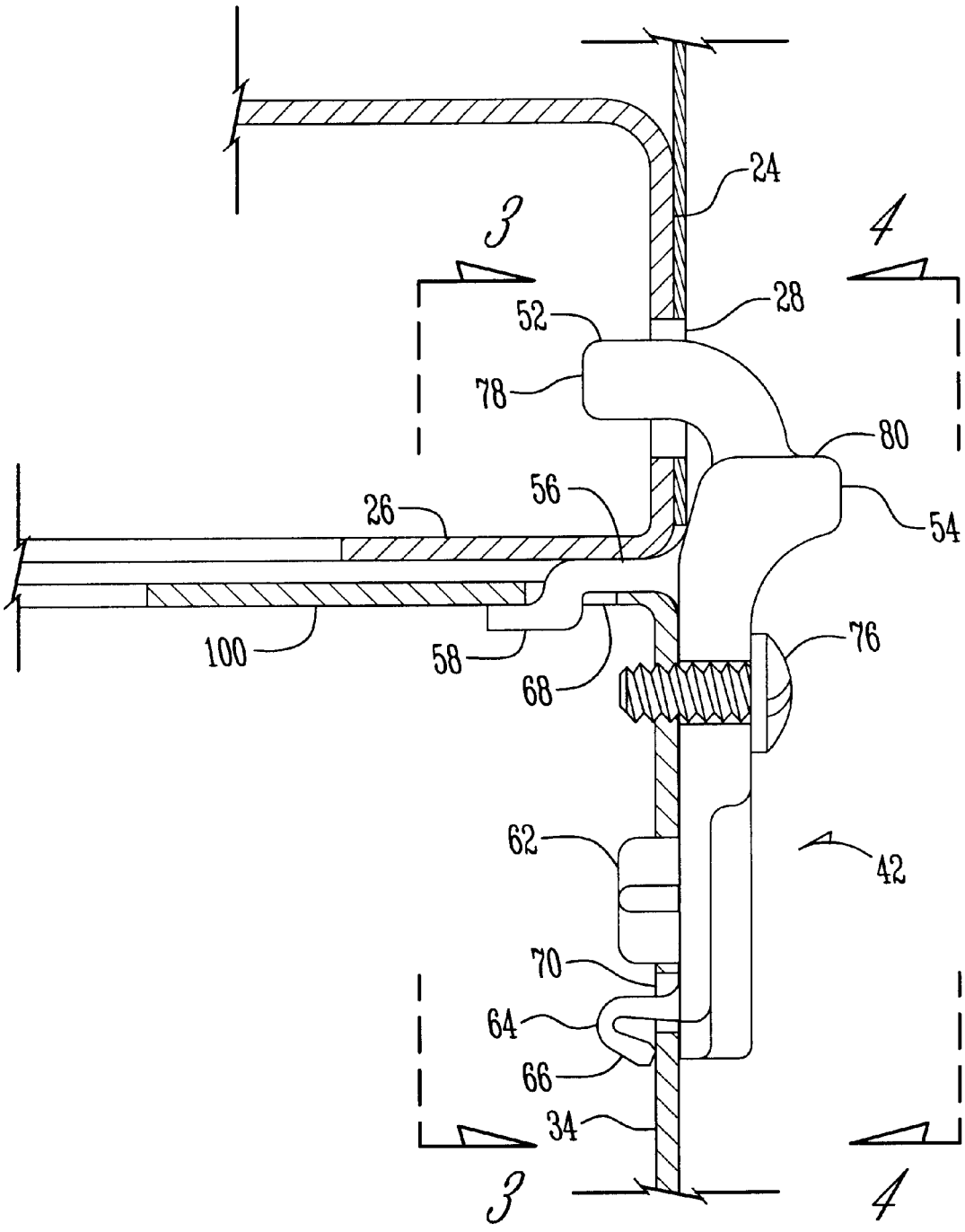
FIG. 2 is an enlarged sectional view of the hinge taken along line 2—2 of FIG. 1.

Referring to the drawings the numeral 10 generally designates an appliance utilizing the top cover hinge of the present invention. While a washing machine is shown in the drawings, many appliances include a top cover hinge to the top of a cabinet, and the present hinge construction may be used with any of these appliances.

Figure 3:
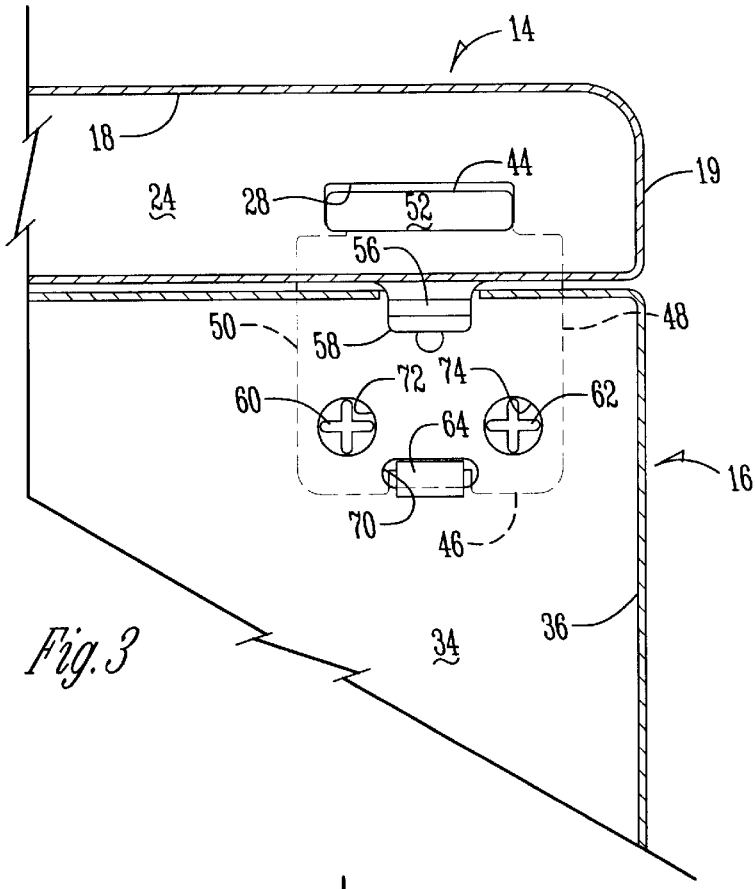
FIG. 3 is a sectional view taken along line 3—3 of FIG. 2.

A cabinet assembly 12 includes a top cover 14 and a remaining cabinet 16. The top cover 14 includes a top wall 18, side walls 19 (FIG. 3), a front wall 20, and a rear hinge wall 24. Front wall 20 is provided with a front flange 22 and rear hinge wall 24 is provided with a rear wall flange 26. The rear hinge wall 24 of top cover 10 includes a hook-receiving hole 28. Mounted on the upper surface of top cover 14 is a console cabinet 30.

The remaining cabinet 16 includes a front cabinet wall 32, a rear cabinet wall 34, and side cabinet walls 36. Extending inwardly from the top of front cabinet wall 32 is a front cabinet flange 37. Attached to the front cabinet flange 37 is a front latch member 38 that extends upwardly and terminates in a latch pawl 40. Latch pawl 40 retentively engages the upper edge of front flange 22 of top cover 14. The latch pawl 40 may be released by insertion of a screw driver between the top cover 14 and the remaining cabinet 16 so as to engage the front latch member 38 and cause it to spring rearwardly. This moves the pawl 40 out of engagement with the front flange 22 and permits upward movement of the front edge of the top cover 14 from the remaining cabinet 16. The particular configuration of the latch 38 and the pawl 40 are shown for illustrative purposes only, and numerous types of latch mechanisms can be utilized to latch the front edge of the top cover 14 to the upper end of the cabinet 16.

The rear cabinet wall 34 is registered below the rear hinge wall 24 of top cover 10. These two walls 24, 34 are retentively secured together by a pair of hinge bodies 42. While not shown in the drawings, there are two or more hinge bodies located across the width of the rear hinge wall 24. Only one of these hinge bodies 42 is shown, the remaining being identical in construction.

Figure 4:
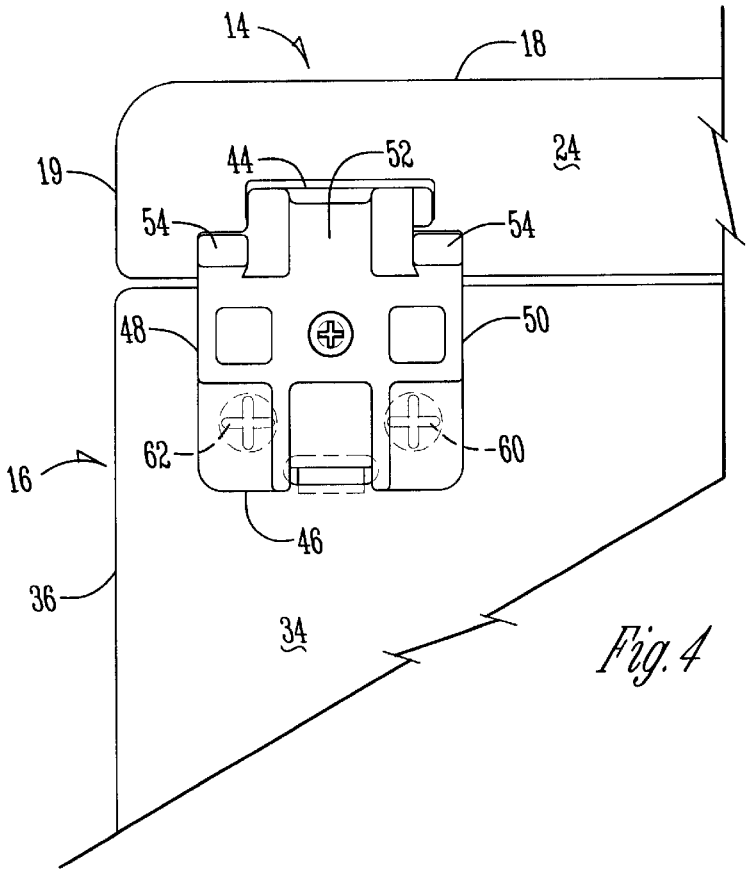
FIG. 4 is a rear elevational view taken along line 4—4 of FIG. 2.

Hinge body 42 includes an upper edge 44 (FIG. 4), a lower edge 46, a side edge 48 and another side edge 50. Extending upwardly at the upper edge 44 is a hook portion 52. Also protruding rearwardly are two stop members 54. Protruding forwardly from the hinge body 42 is an upper appendage 56 having a stepped end 58. Also extending forwardly from hinge body 42 are a pair of side appendages 60, 62, and a bottom appendage 64. The bottom appendage 64 includes a pawl end 66.

To accommodate the appendages 56, 60, 62, and 64, the cabinet 16 is provided with a top hole 68, a bottom hole 70, and a pair of side holes 72, 74. The upper appendage 56 extends into the top hole 68, and the stepped end 58 extends through the top hole 68 and beneath a flange 100 which forms a part of the rear cabinet wall 34. This stepped end 58 helps to retain the hinge body 42 in the proper position relative to the rear cabinet wall 34.

In addition the bottom appendage 64 extends into the bottom hole 70 of cabinet 16 and the pawl end 66 engages the interior surface of the rear cabinet wall 34 so as to further retentively hold the hinge 42 in place.

Side appendages 60, 62 extend within the two side holes 72, 74 and provide further stable attachment of the hinge body 42 to the rear cabinet wall 34.

A screw 76 extends through both the hinge body 42 and the rear wall 34 and, by virtue of it's threaded engagement with rear wall 34, retentively attaches the hinge body 42 to the rear wall 34. Securing means other than screw 76 may be used without departing from the invention.

The hook member 52 is provided at its end with a first stop surface 78, and the two stop members 54 are each provided with an upwardly presented stop surface 80. Stop surface 78 is vertical and stop surface 80 is horizontal.

Figure 5:
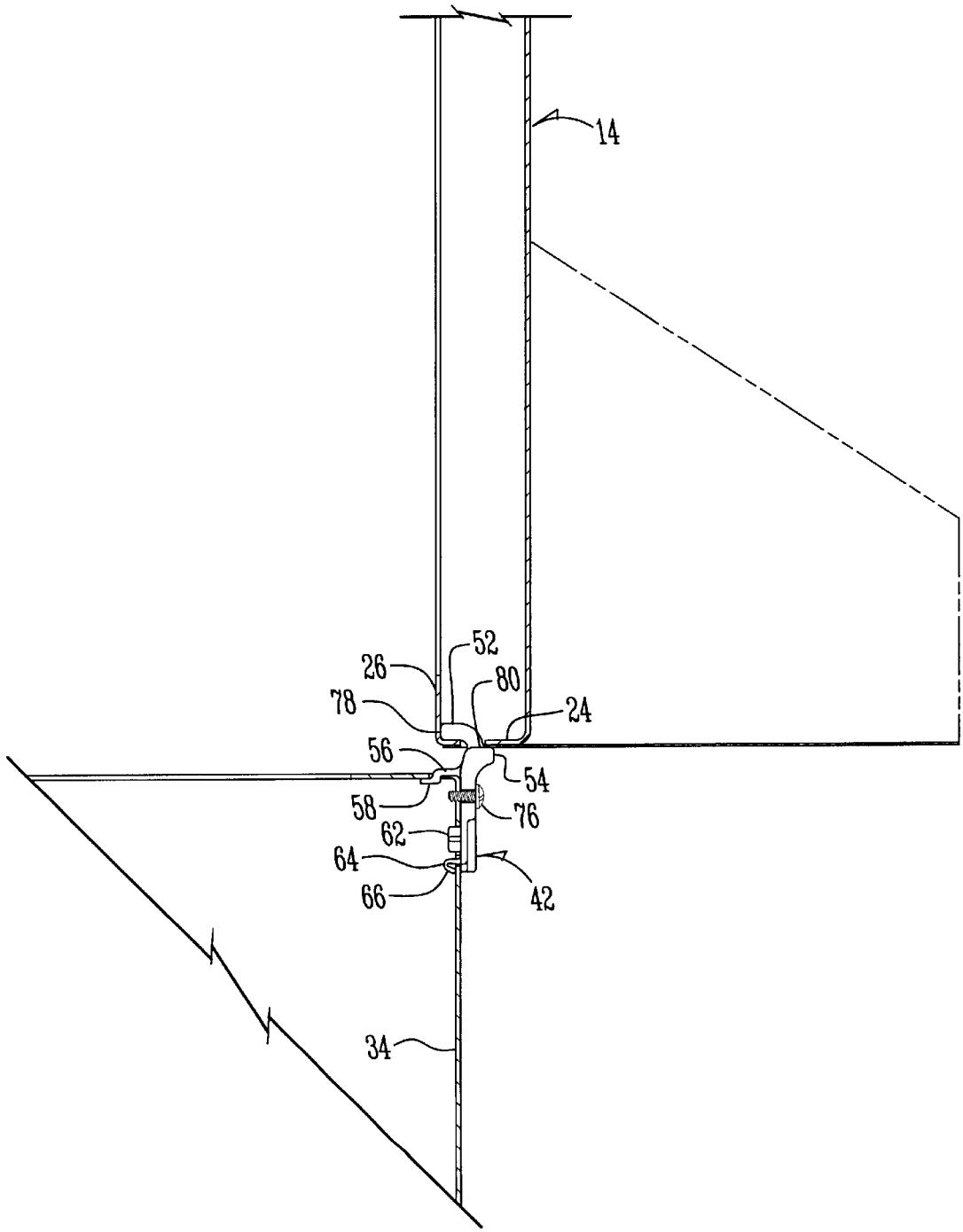
FIG. 5 is a view similar to FIG. 1, but showing the top cover in its elevated position.

As can be seen in FIG. 5, the top cover 14, when pivoted to its elevated position comes to rest against the stop surfaces 78, 80. The rear hinge wall 24 rests against stop surface 80 and the rear wall flange 26 rests against the stop surface 78. This permits the operator to elevate the top cover 14 and maintain it in its elevated position during repair of the appliance.

The particular configuration of the hinge may vary without detracting from the invention. It is preferable that the hinge be of singular unitary construction, but it is also possible that the hinge may be made of more than one part. It is also preferable that the hinge body 42 be constructed of plastic, but the hinge body 42 could be made of other materials such as metal without detracting from the invention.

Figure 6:
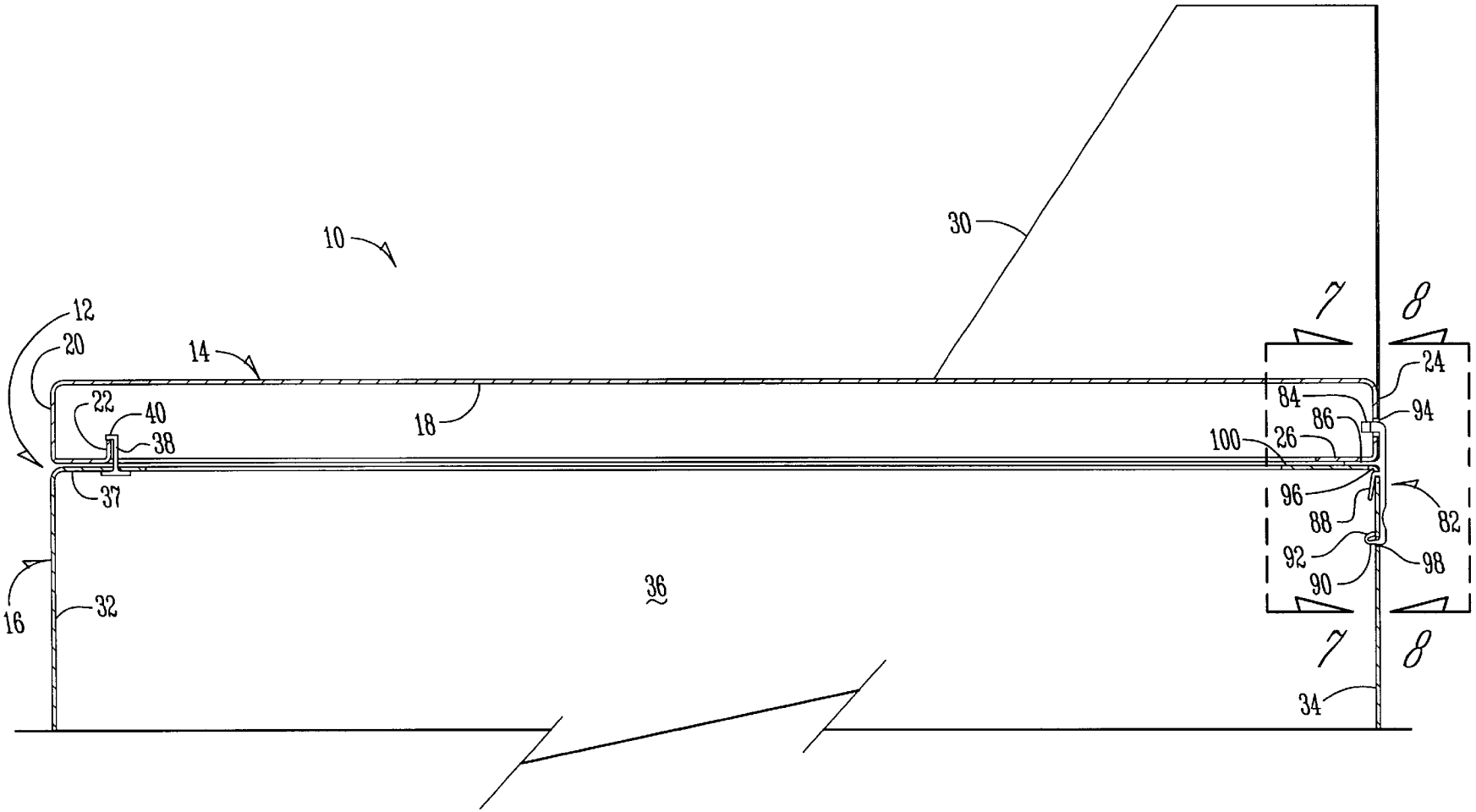
FIG. 6 is a view similar to FIG. 1, but showing a modified form of the hinge of the present invention.

The numeral 82 generally designates a modified hinge body shown in FIG. 6. This hinge body 82 includes a hook portion 84, an upper appendage 86, a middle appendage 88, and a lower appendage 90. The lower appendage 90 has a snap pawl 92. The top cover 14 includes a hook-receiving hole 94 for receiving the hook portion 84. The middle appendage hole 96 of cabinet wall 34 receives the middle appendage 88. The middle appendage 88 protrudes downwardly and engages the interior surface of rear wall 34, thereby retentively engaging the hinge body 82 to the rear wall 34 of cabinet 16. The upper appendage 86 of hinge body 82 protrudes between the rear wall flange 26 of top cover 14 and the rearwardly extending flange 100 of cabinet 16. The upper appendage 86 provides a spacer between these two flanges and also, in combination with the middle appendage 88, further secures the hinge body 82 to the rear wall 34 of cabinet 16.

The lower appendage 90 protrudes within the lower appendage hole 98 of rear wall 34, and the snap pawl 92 further attaches the hinge body 82 to the rear wall 34. Top cover 14 is adapted to pivot about the hook portion 94 in the manner described before as to the first modification. The end of hook portion 84 engages flange 26 in the upper most position so as to provide a stop surface for limiting the upper pivotal movement of the top cover 14.

Figure 7:
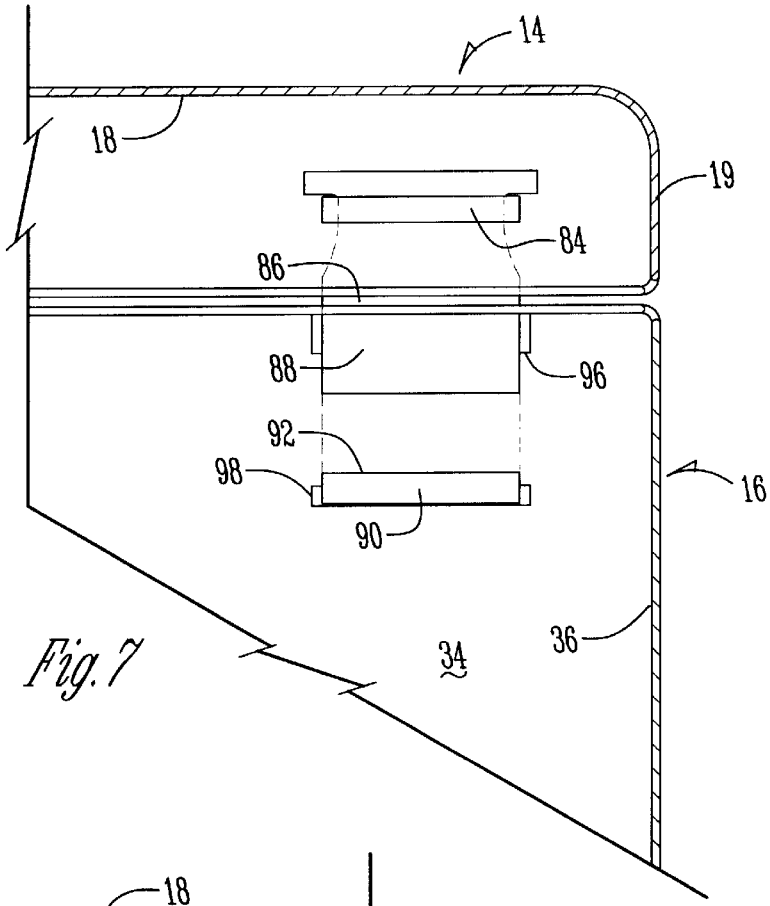
FIG. 7 is a sectional view taken along line 7—7 of FIG. 6.
Figure 8:
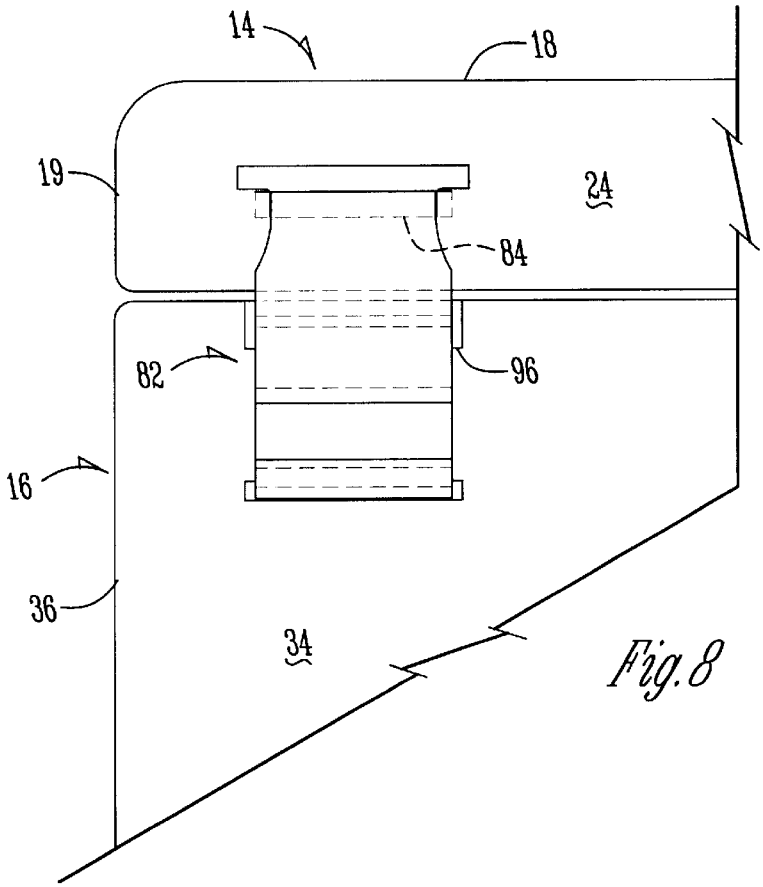
FIG. 8 is a rear elevational view taken along line 8—8 of FIG. 6.

As can be seen in FIGS. 7 and 8, the hook portion 84 has approximately the same width as the remaining portion of hinge body 82. Similarly, as seen in FIG. 7, the middle flange 88 and the lower flange 90 are of the same width as the entire width of the hinge body 82. It is preferable that this width be at least equal to or greater than 50% of the width of the hinge body 82 so as to impart stability to the attachment between the top cover 14 and the cabinet 16.

Both of the hinge bodies 42 and 82 provide stability to the attachment between the top cover 14 and the cabinet 16. They prevent movement of the top cover in a forward or rearward direction or in a lateral direction relative to the cabinet 16. Furthermore they space the top cover 14 slightly upwardly from the upper edge of the cabinet 16 so as to minimize vibration or contact therebetween.

The hook portions 52, 84 are shown to curve about an approximate 90° turn. However, the curvature of hook portions 52, 84 could be increased or decreased substantially without detracting from the invention.

The term "appendages" includes appendages of varying shapes and sizes. The appendages may be flanges, tabs, posts, or other objects having varying configurations.

The term "hook" refers to an appendage of any sort that changes angles from the surface of the body 42, 82, and that is capable of protruding into the hook receiving opening of the top cover 10. The hook 52, 84 may curve varying degrees, and may have different shapes and configurations without detracting from the invention. The hook 52, 84 remains stationary after attachment to cabinet 16 so that it does not articulate or fold with respect to the remaining hinge body 82.

Specific structure details disclosed above are not to be interpreted as limiting the scope of the invention, but merely as a basis for the claims and for teaching one skilled in the art to employ the present invention in any appropriately detailed structure. Changes may be made in the specific structural details of that particular embodiment without departing from the spirit of the invention, especially as defined in the following claims.

What is claimed is:

1. A hinge for hinging the top cover of an appliance to a remaining cabinet of said appliance; said top cover having a top cover hinge edge, said remaining cabinet having a cabinet hinge edge, said hinge comprising:

a hinge body comprising an upper end, a lower end, first and second opposite lateral edges, a front face, and a rear face;

said hinge body having one or more appendages protruding outwardly from said front face of said hinge body;

said hinge body having a hook formed therein and protruding upwardly from said upper edge of said hinge body, said hook extending forwardly beyond said front face of said hinge body and terminating in a hook end, said hook being stationary with respect to said hinge body whereby said hook does not articulate or fold with respect to said hinge body.

2. A hinge according to claim 1 wherein said hinge body is of one-piece construction.

3. A hinge according to claim 2 wherein at least one of said appendages extends from said front face adjacent and below said hook.

4. A hinge according to claim 3 wherein a second of said appendages extends from said front face adjacent and above said lower end of said hinge body.

5. A hinge according to claim 4 wherein a third of said appendages is positioned adjacent said first lateral edge between said first and second appendages and a fourth of said appendages is positioned adjacent said second lateral edge between said first and second appendages.

6. A hinge according to claim 4 wherein said first and second appendage each have a lateral width extending between said first and second lateral edges of said hinge body, said lateral widths of said first and second appendages being greater than one-half of the distance between said first and second opposite edges of said hinge body.

7. A hinge according to claim 6 wherein said lateral widths of said first and second appendages is approximately the same as the distance between said first and second opposite edges of said hinge body.

8. In combination:

a top cover having a top cover hinge edge and a hook receiving hole extending through said top cover;

a remaining cabinet having a cabinet wall registered generally below said top cover hinge edge;

a hinge body attached to said cabinet wall;

said hinge body having a hook portion extending through said hook receiving hole of said top cover and providing a hinge fulcrum for permitting said top cover to pivot with respect to said hook portion about a hinge axis.

9. The combination according to claim 8 wherein said hinge body is of one-piece construction.

10. The combination according to claim 9 wherein said hinge body further comprises a first stop surface positioned to engage said top cover so as to limit hinged movement of said top cover about said hinge axis.

11. The combination according to claim 10 wherein said hinge body further comprises a second stop surface positioned to engage said top cover simultaneously with said engagement by said first stop surface for limiting hinged movement of said top cover about said hinge axis.

12. The combination according to claim 11 wherein said first and second stop surfaces are perpendicular to one another.

13. The combination according to claim 8 wherein said hinge body comprises an upper end, a lower end, first and second opposite sides, a front face and a rear face; said front face engaging said cabinet wall.

14. The combination according to claim 8 wherein said cabinet wall includes a first appendage-receiving hole therein, said hinge member having a first appendage extending into said first appendage receiving hole.

15. The combination according to claim 14 wherein said cabinet wall includes a second appendage-receiving hole therein, said hinge member having a second appendage above said first appendage and extending into said second appendage-receiving hole.

16. The combination according to claim 15 wherein said cabinet wall includes third and fourth appendage-receiving holes therein, said hinge body comprising third and fourth appendage extending into said third and fourth appendage-receiving holes respectively.

17. The combination according to claim 14 and further comprising a securing member attaching said hinge body to said cabinet wall.

18. The combination according to claim 8 wherein said hook is stationary with respect to said hinge body whereby said hook does not articulate or fold with respect to said hinge body.

19. A method for hinging a top cover having a hinge edge to a cabinet wall registered below said hinge edge, said method comprising:

attaching a hinge body to said cabinet wall, said hinge body having a hook portion extending above said cabinet wall when said hinge body is attached thereto;

inserting said hook portion of said hinge body into a hook receiving hole in said top cover; and pivoting said top cover about a fulcrum created by said hook portion from a horizontal position to a vertical position.

20. A method according to claim 19 and further comprising inserting a plurality of appendages on said hinge body into a plurality of appendage-receiving holes in said cabinet wall so as to stabilize said hook member against movement with respect to said cabinet wall.

21. A method according to claim 20 and further comprising using a securing member extending through both of said hinge body and said cabinet wall to attach said hinge body to said cabinet wall.

22. The method according to claim 19 and further comprising maintaining said hook portion in a stationary position during said pivoting of said top cover.

23. A hinge for hinging the top cover of an appliance to a remaining cabinet of said appliance; said top cover having a top cover hinge edge, said remaining cabinet having a cabinet hinge edge, said hinge comprising:

a hinge body comprising an upper end, a lower end, first and second opposite lateral edges, a front face, and a rear face;

said hinge body having a hook formed therein and protruding upwardly from said upper edge of said hinge body, said hook extending forwardly beyond said front face of said hinge body and terminating in a hook end;

said hinge body having a first appendage protruding outwardly from said front face of said hinge body below said hook;

said hinge body having a second appendage extending from said front face adjacent and above said lower end of said hinge body;

said first and second appendages each having a lateral width extending between said first and second lateral edges of said hinge body, said lateral widths of said first and second appendages being greater than one-half of the distance between said first and second opposite edges of said hinge body.

24. A hinge for hinging the top cover of an appliance to a remaining cabinet of said appliance; said top cover having a top cover hinge edge, said remaining cabinet having a cabinet hinge edge, said hinge comprising:

a hinge body comprising an upper end, a lower end, first and second opposite lateral edges, a front face, and a rear face;

said hinge body having a hook formed therein and protruding upwardly from said upper edge of said hinge body, said hook extending forwardly beyond said front face of said hinge body and terminating in a hook end;

said hinge body having a first appendage protruding outwardly from said front face of said hinge body below said hook;

said hinge body having a second appendage extending from said front face adjacent and above said lower end of said hinge body;

said hinge body having a third appendage positioned adjacent said first lateral edge between said first and second appendages; and said hinge body having a fourth appendage positioned adjacent said first lateral edge between said first and second appendages.

* * * * *